United States Patent [19]

Kaaria

[11] Patent Number: 4,753,420

[45] Date of Patent: Jun. 28, 1988

[54] RAILING SYSTEM

[76] Inventor: Ray T. Kaaria, 2253 West 2nd Ave., Vancouver, B.C., Canada

[21] Appl. No.: 70,029

[22] Filed: Jul. 6, 1987

[51] Int. Cl.[4] ..... E04H 17/14

[52] U.S. Cl. ..... 256/59; 256/1; 52/300

[58] Field of Search ..... 256/59, 65, 1; 52/300, 52/58

[56] References Cited

U.S. PATENT DOCUMENTS 3,454,262 7/1969 Romano ..... 256/19

3,818,663 6/1974 Adlam ..... 52/300

*Primary Examiner*—Andrew V. Kundrat

*Attorney, Agent, or Firm*—Barrigar & Oyen

[57] ABSTRACT

A railing system which combines wooden posts with an aluminum railing cap is provided. Anchor clips are utilized at spaced locations on the top horizontal wooden rail to secure the aluminum cap and act as a spacer. A post anchor is provided which allows the wooden posts to be readily secured to a horizontal surface.

8 Claims, 5 Drawing Sheets

RAILING SYSTEM

BACKGROUND OF THE INVENTION

The invention relates to the field of wooden railings.

Wooden railings for home or patio construction are popular due both to the pleasing appearance of wood as opposed to metal or plastic, and the lower cost of such railings. A conventional wooden railing consists of vertical posts installed at regular intervals connected by a lower horizontal railing and a top horizontal railing. There may be vertical slats joining the top and bottom rails to fill the space between the posts. The posts may either be anchored in the ground, or may be secured to a horizontal surface using nails or screws or angle irons.

The problem with wooden railing systems particularly in damp climates, is that the wood tends to rot, particularly at joints such as the corners and where the top rail is joined to the posts. While metal or plastic railings do not have the problem of rotting, they are less aesthetically pleasing and tend to be more expensive. In view of the foregoing, it is desirable to provide a railing system which combines the aesthetic values of a wooden railing system with the durability of aluminum.

The present invention therefore provides a railing system which combines wooden posts with aluminum top and bottom rails. The system utilizes an aluminum top rail which is readily installed using anchor clips which are screwed onto a top horizontal wooden member. The anchor clips raise the aluminum top rail above the wooden member, allowing circulation of air. An aluminum lower railing is adapted to receive either wooden pickets or glass panels. The system further incorporates a post anchor having a metal base for securing to a deck surface and having a unitary wood screw secured to the base. A base plate having a central hole is attached to the bottom surface of the post and a wooden post may in this way be rapidly screwed onto the post anchor.

BRIEF DESCRIPTION OF THE DRAWINGS

In drawings which illustrate an embodiment of the invention.

DETAILED DESCRIPTION OF AN EMBODIMENT OF THE INVENTION

Figure 1:
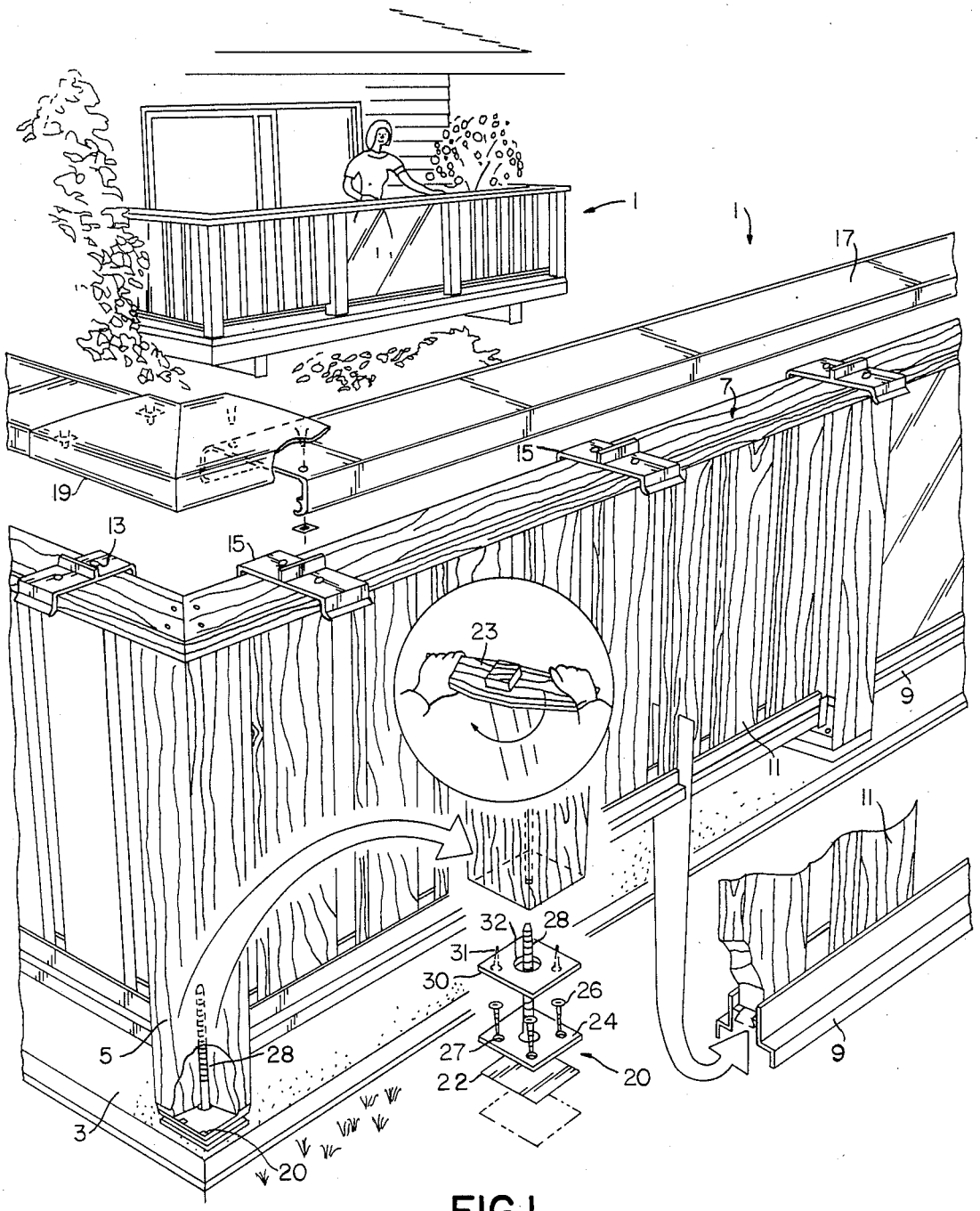
FIG. 1 is an exploded perspective view of the railing system of the invention.

With reference to FIG. 1, the railing system of the invention, designated generally as 1, is mounted on the edge of the deck 3. It consists of a series of wooden posts 5 joined by wooden top rails 7 and aluminum bottom rails 9. The top and bottom rails are joined by wooden pickets 11.

Secured by screws 13 to the top of railings 7 are anchor clips 15 at regular intervals. Top railing caps 17, and corner caps 19 are in turn secured to the top of the top railings by means of the anchor clips in a manner described below.

Posts 5 are secured to deck 3 using post anchors 20. A neoprene pad 22 is laid in position on deck 3. The post anchor base plate 24 is secured to the deck 3 on top of pad 22 using screws 26 through holes 27 in the base plate. Mounted on base plate 24, by welding or similar means is a vertical wood screw 28. A second metal plate 30 is secured to the bottom surface of post 5 using screws 31 or similar means. Plate 30 has a central aperture 32 to receive wood screw 28.

To mount post 5 on deck 3, the post is centered over wood screw 28 and is simply screwed down onto wood screw 28. This may be done using an elongate piece of wood 23 having a square cut-out sized to fit snugly over the top of the post and which allows the post to be turned manually using the leverage of length of the handle. The metal plate 30 secured to the bottom of the post allows a tight fit to be achieved as the plates 30 and 24 will permit the post to continue to be turned even when a tight contact has been made.

Figure 2:
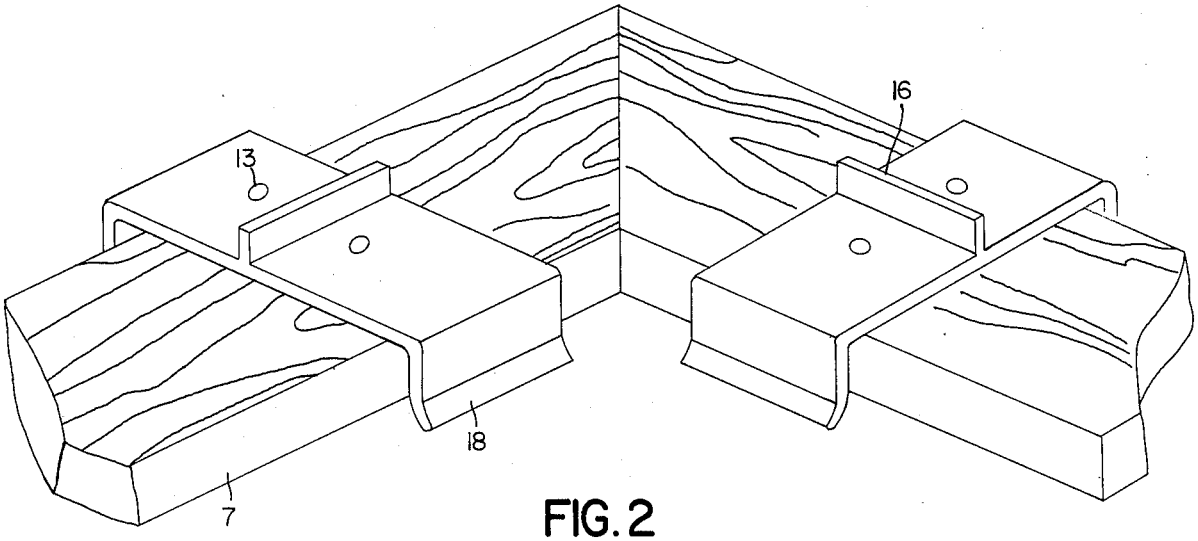
FIG. 2 a detailed view, partially cut away, showing the anchor clips of the invention.
Figure 8:
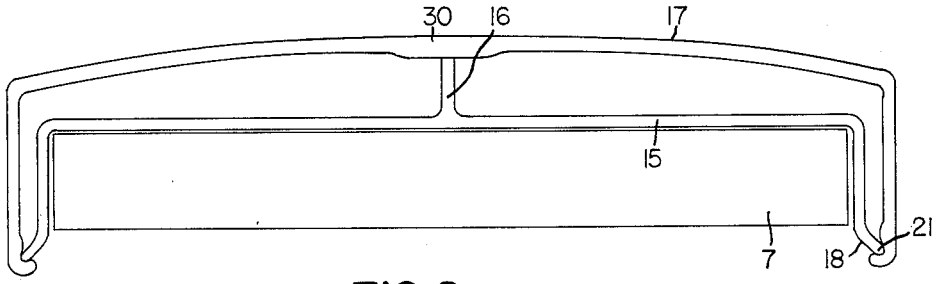

FIGS. 2 and 8 show the anchor clips 15 in further detail. They are secured to top railing 7 every two or three feet by means of screws or nails 13. They reguire at least one inch clearance from the inside edge of the intersecting top railing at the corners. The anchor clips have a vertical rib 16 which supports the rail caps. The clips are centered on the top railing, and extend a short distance over either edge of the top railing 7.

Figure 7:
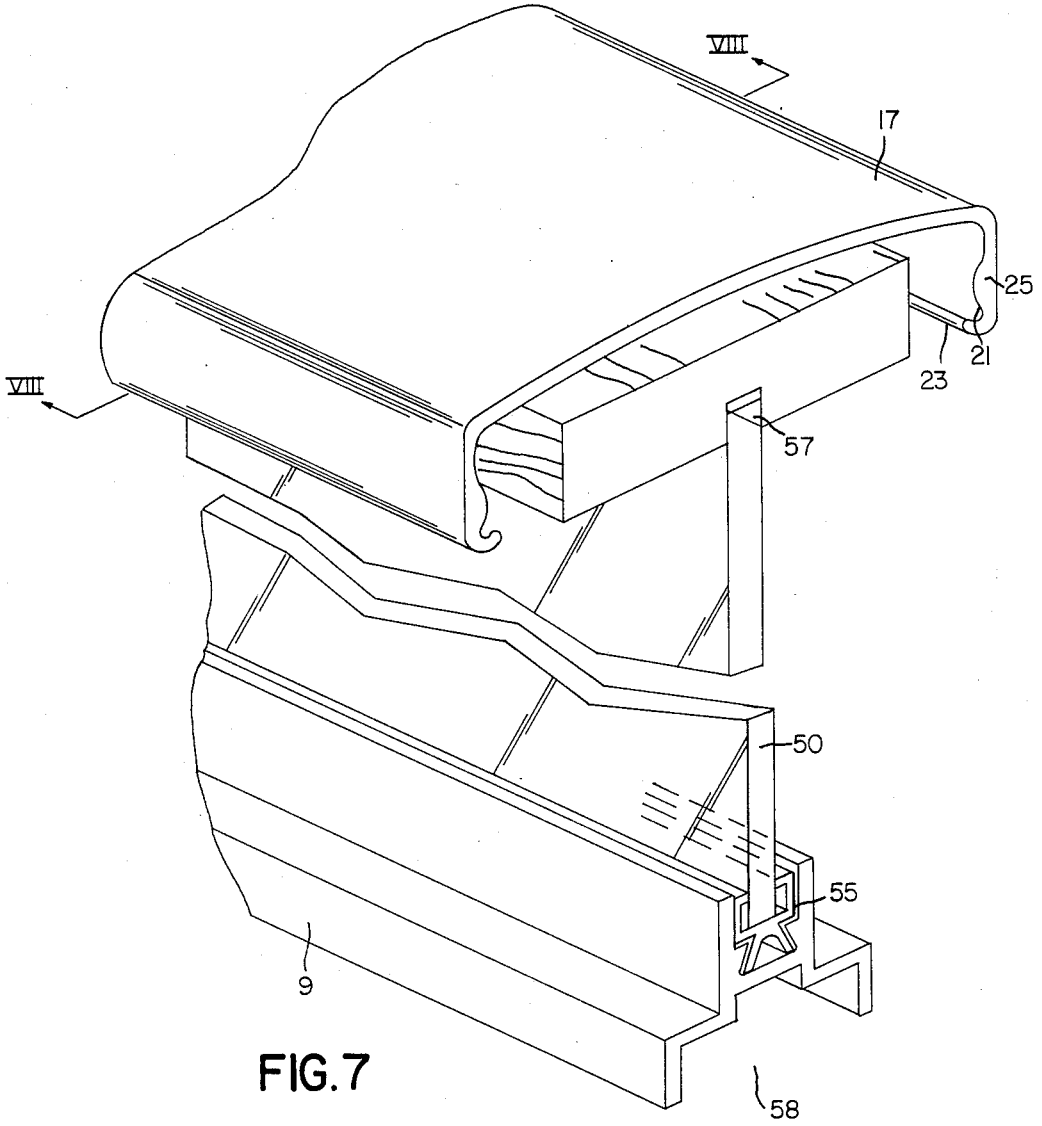
FIG. 7 is a detailed view, partially cut away and in cross-section, showing the top and bottom rails of the invention with a glass panel in place; and, FIG. 8 is a cross-sectional view taken along lines VIII—VIII of FIG. 7.

The anchor clips 15 are formed of extruded aluminum. They have a downward and outward extending lip 18 onto which the rail cap is clipped. As shown in FIG. 7, the rail cap 17 incorporates an inward facing groove 21. Cap 17 is also formed of extruded aluminum and has sufficient flexibility so that groove 21 may be snapped onto lip 18 of the anchor clips. At the same time the caps have sufficient rigidity to cause the connection to be firm. Thickening of the cap at 30 prevents the rib 16 from deforming the smooth upper surface of the cap.

Figure 3:
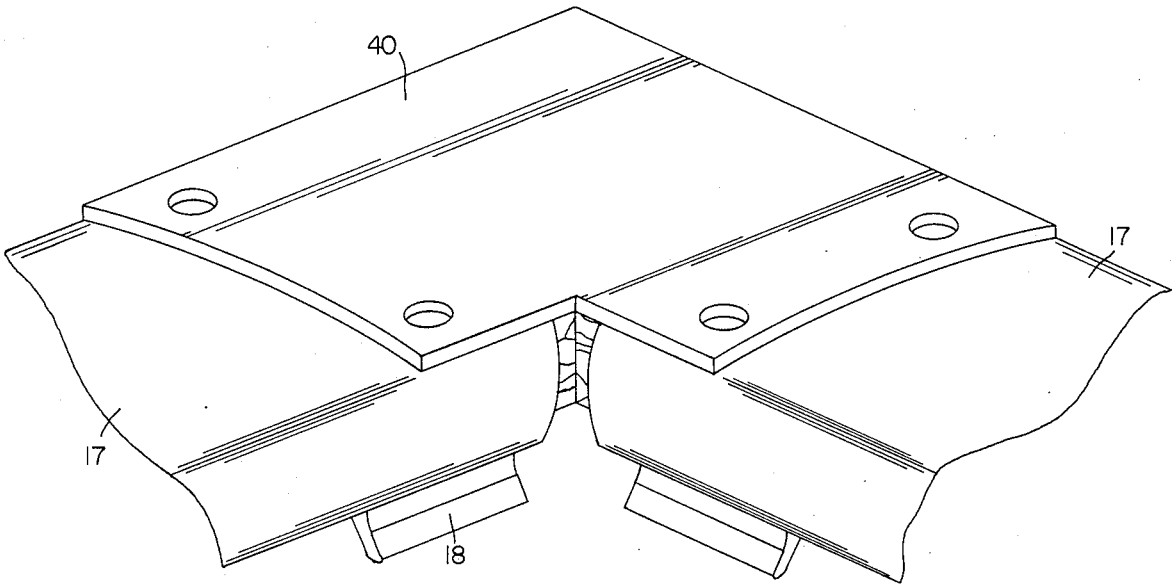
FIG. 3 is a detailed view, partially cut away, showing the method of corner construction of the railing system of the invention.
Figure 4:
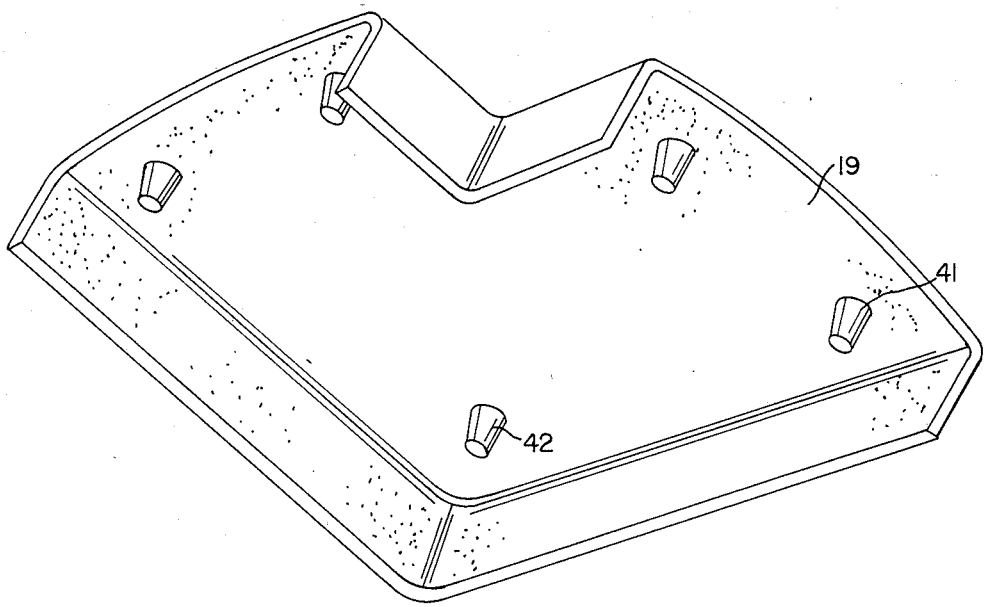
FIG. 4 is a perspective view from below of the corner element of the rail cap of the invention.
Figure 5:
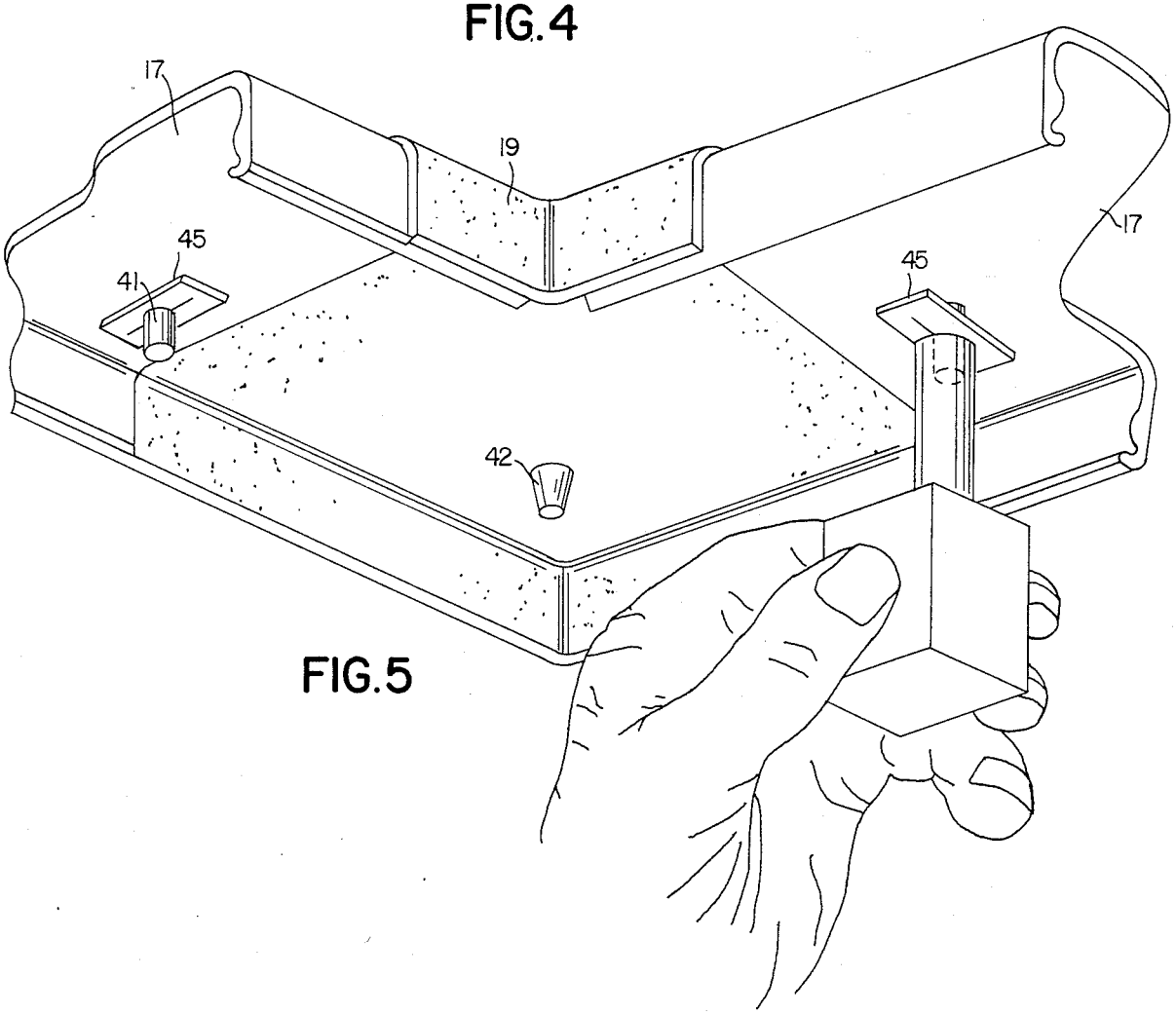
FIG. 5 is a perspective view from below, partially cut away, showing the corner construction of the rail cap of the invention.

In order to form the corners, the railing caps are connected to the corner caps prior to snapping onto the anchor clips in the following fashion. As shown in FIG. 3, a template 40 is used to properly position the holes for securing the corner cap to railing caps 17. With reference to FIG. 4, the corner caps 19 have studs 41 on the undersurface of the corner caps. The corner caps are also formed of cast aluminum. The stabilizer stud 42 is also used to support the corner cap on top of the top wood plate. Once holes have been drilled in railing caps 17 in four locations to receive studs 41, the corner cap 19 is installed over railing cap 17 with studs 41 extending through the holes, and clips 45 are installed onto the studs to secure the corner cap in place. The type of clips which are referred to as "speed nuts" are suitable for this purpose. It is useful to provide a bead of sealant between the undersurface of the corner cap and the top of the railing cap to seat and seal the corner. Once the corners have been installed, the entire railing cap is clipped onto anchor clips 15 and thereby secured over top railing 7. The presence of an air space between railing cap 17 and top railing 7 permits circulation of air and inhibits rotting of top railing 7.

Figure 6:
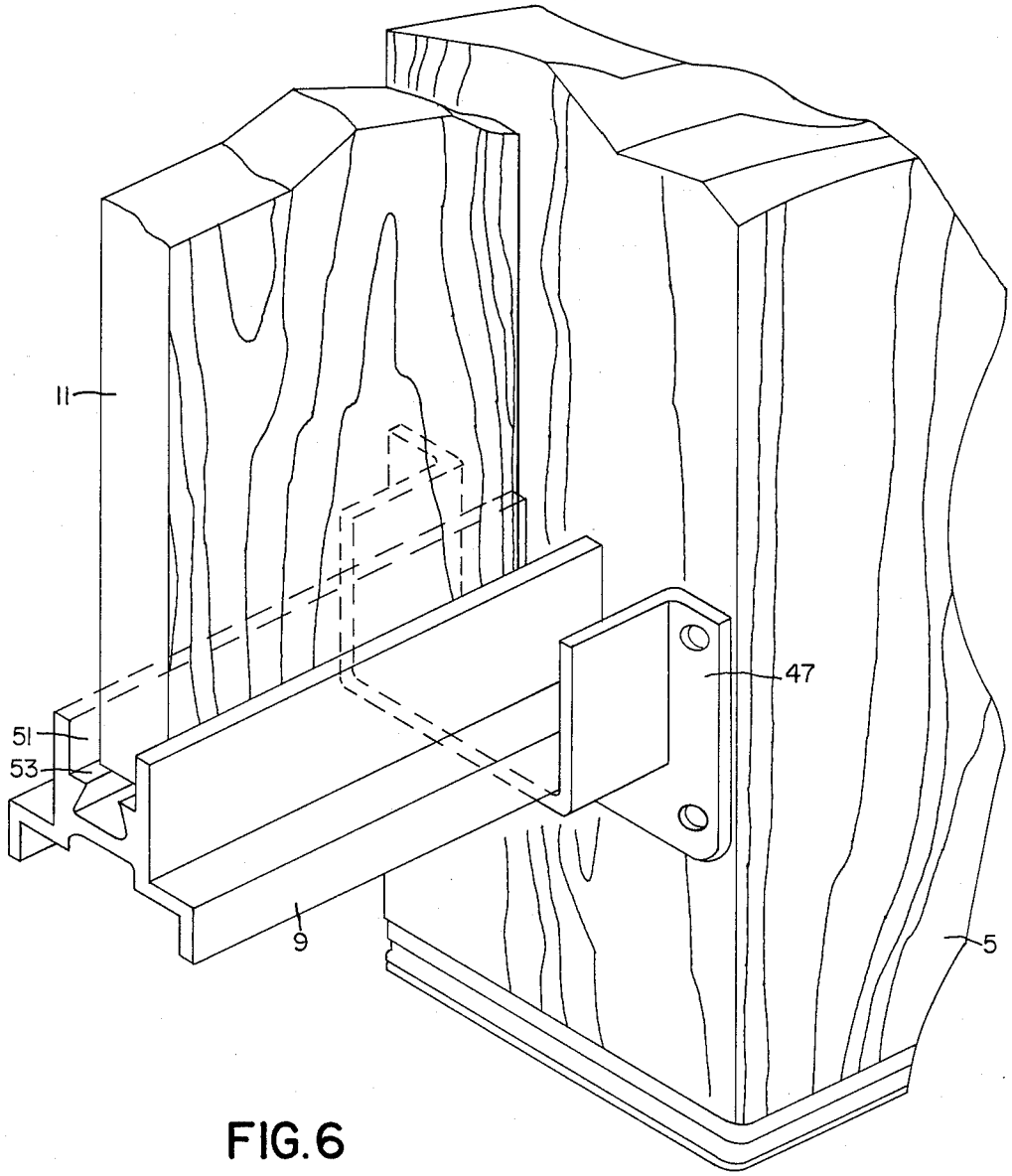
FIG. 6 is a detailed view, partially cut away, showing the lower rail construction of the invention.

Bottom railing is also formed of extruded aluminum. It is secured to post 5 by bracket 47 as shown in FIG. 6. The bottom rail 9 is shaped to receive either a wooden picket 11, or a glass plate 15. In the case of a wooden picket 11, the width of the U-shaped opening 51 in lower rail 9 is such as to receive the width of picket 11 with the lower edge of the picket resting on steps 53. The pickets are secured to the bottom rail by use of screws through the underside of the bottom rail. The bottom rail is provided with weep holes either by a mechanical punch during the manufacturing process or by drilling on site so that water can escape and prevent rotting. When glass panel 50 is utilized, a rubber adapter 55 is slid into the channel in the bottom of the rail and the rubber adapter receives the bottom edge of the glass panel. The bottom edge of the top railing 7 is provided with a channel 57 whose width is selected to receive either a glass panel or the wooden picket. The lower railing 9 is also reversible to allow it to be adapted to receive a two-inch as opposed to a one-inch picket in U-shaped channel 58.

By utilizing the post anchor system disclosed, a shorter wooden post than normally would be reguired is used. Further, as will be understood from the above description, the joints between the top wooden railing and the post are less likely to rot by virtue of the protection afforded by the aluminum cap. In addition, the aluminum cap provides better wear characteristics than a wooden top railing, while the vertical posts preserve the aesthetic features of a wood railing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A railing system comprising:

(a) vertical wooden support posts;

(b) horizontal wooden top railings connecting said support posts;

(c) anchor clips for securing to said top rail; and, (d) an aluminum rail cap member provided with a groove for a snap fitting over said anchor clips for securing said cap on said top railing.

(e) said anchor clip having an elongate planar surface adapted for securing to said top rail, and having at either end of said planar surface downwardly and outwardly extending flanges adapted to seat in said groove of said rail cap.

2. The railing system of claim 1 wherein said anchor clip comprises a central rib projecting vertically from said surface and running at right angles to said planar surface.

3. The railing system of claim 2 further comprising corner cap members adapted for securing to the ends of two of said cap members.

4. The railing system of claim 3 further sleeve members for covering joints in said cap members.

5. The railing system of claim 4 further comprising a lower rail adapted to receive the edge of a wooden picket, and further provided with means for receiving the edge of a glass plate.

6. The railing system of claim 5 wherein said lower railing is reversible to receive a second size of wooden picket.

7. The railing system of claim 6 further comprising means for securing said post to a deck comprising:

(a) plate means adapted to be secured to said deck;

(b) screw threaded means mounted on said plate and adapted to be screwed into the bottom of said post; and, (c) plate means secured to the bottom of said post and provided with an aperture for receiving said screw threaded means.

8. A method of installing a railing system to a horizontal surface comprising:

(a) securing a series of plates having vertically oriented screw threads attached thereto to said horizontal surface;

(b) screwing a wooden post onto said screw threads;

(c) securing wooden top railings to extend between the tops of said posts;

(d) securing anchor clips at spaced location on said top railing; and, (e) clipping aluminum railing caps on said anchor clips.

* * * * *